US005225797A

United States Patent [19]

Schary et al.

[11] Patent Number: 5,225,797

[45] Date of Patent: Jul. 6, 1993

[54] DIELECTRIC WAVEGUIDE-TO-COPLANAR TRANSMISSION LINE TRANSITIONS

[75] Inventors: Alison Schary; G. Conrad Dalman; Charles A. Lee, all of Ithaca, N.Y.

[73] Assignee: Cornell Research Foundation, Inc., Ithaca, N.Y.

[21] Appl. No.: 873,796

[22] Filed: Apr. 27, 1992

[51] Int. Cl.[5] ..... H01P 5/12; H01P 5/10

[52] U.S. Cl. ..... 333/125; 333/21 A; 333/26; 333/128

[58] Field of Search ..... 333/21 A, 26, 33, 34, 333/125, 128, 137, 239

[56] References Cited

U.S. PATENT DOCUMENTS

| | | | |
|---|---|---|---|
| 2,745,101 | 5/1956 | Marie . | |
| 2,979,676 | 4/1961 | Rueger . | |
| 3,452,302 | 6/1969 | Hayanv . | |
| 3,626,335 | 12/1971 | Hord et al. | 333/21 A X |
| 3,835,421 | 9/1974 | De Brecht et al. | 333/26 |
| 4,692,720 | 9/1987 | Auracher | 333/33 |
| 4,742,571 | 5/1988 | Letron | 333/26 X |
| 4,745,377 | 5/1988 | Stern et al. | 333/26 |
| 4,843,353 | 6/1989 | Sequeira | 333/34 |
| 4,851,794 | 7/1989 | Williams et al. | 333/33 |
| 4,906,953 | 3/1990 | Li | 333/33 |
| 4,952,892 | 8/1990 | Kronberg | 333/34 |
| 5,107,231 | 4/1992 | Knox | 333/26 X |

OTHER PUBLICATIONS

Stix, G., "*Scientific American*, Second-Generation Silicon Band-gap engineering may keep silicon a winner", pp. 110–111, Jan. 1991.

Strube, J. et al., *IEEE Transactions on Microwave Theory and Techniques*, "Rigorous Hybrid-Mode Analysis of the Transition from Rectangular Waveguide to Shielded Dielectric Image Guide", vol. MTT-33, No. 5, pp. 391–401, May 1985.

Bhooshan, S. et al., *IEEE Transactions on Microwave Theory and Techniques*, "On the Design Transitions Between a Metal and Inverted Strip Dielectric Waveguide for Millimeter", vol. MTT-29, No. 3, pp. 263–265, Mar. 1981.

Marcatili, E. A. J., *Bell System Technical Journal*, "Dielectric Rectangular Waveguide and Directional Coupler for Integrated Optics", vol. 48, No. 7, pp. 2071–2103, Sep. 1969.

Patton, G. L. et al., *IEEE Electron Device Letters*, "75-GHz fT SiGe-Base Heterojunction Bipolar Transistors", vol. 11, No. 4, pp. 171–173, Apr. 1990.

Snyder, A. W. et al., *Optical Waveguide Theory*, "Waveguides with exact solutions", Sections 12-10 – 12-11, p. 258, London, N.Y.

(List continued on next page.)

*Primary Examiner*—Paul Gensler

*Attorney, Agent, or Firm*—Jones, Tullar & Cooper

[57] ABSTRACT

Dielectric waveguide-to-transmission line transition structures are disclosed which can be used to interface low loss dielectric waveguides with integrated electric circuits for operation in millimeter wave frequency ranges on the order of 100 GHz. Numerous transition designs are presented for interfacing signal propagation in rectangular or cylindrical coplanar metallic transmission lines to signal propagation in dielectric waveguides. In one embodiment of the present invention, a transition structure is provided which includes a first transition section for interfacing a dielectric waveguide to a microstrip transmission line, and a second transition section for interfacing the microstrip transmission line to a coplanar transmission line. In other embodiments of the present invention, the dielectric waveguide interfaces directly to a coplanar transmission line. One embodiment employs a "T" junction for splitting a vertically polarized incoming signal in a dielectric waveguide into two horizontally polarized signals for propagation along a coplanar transmission line. Power splitter and polarization rotation structures are also provided in which either signals from a pair of dielectric waveguides can be combined in a single coplanar transmission line or the polarization of a signal can be changed prior to entering a transition structure.

10 Claims, 8 Drawing Sheets

OTHER PUBLICATIONS

Hoover, J. C. et al., *IEEE Transactions on Microwave Theory and Techniques,* "Microstrip Transmission-Line Transitions to Dielectric-Filled Waveguide", pp. 273-274, Apr. 1967.

Malherbe, J. A. G. et al., *IEEE Transactions on Microwave Theory and Technique,* "A Transition from Rectangular to Nonradiating Dielectric Waveguide", vol. MTT-33, No. 6, pp. 539-543, Jun. 1985.

Malherbe, J. A. G., *IEEE MTT-S Digest,* "A Transition to Non-Radiating Dielectric Waveguide", Intn'l Microwave Symposium, pp. 505-507, 1984.

Ponchak et al., *A New Rectangular Waveguide to Coplanar Waveguide Transition,* 1990, *IEEE MTT-S* Digest, presented May 8, 1990, pp. 491, 492.

FIG. 3E
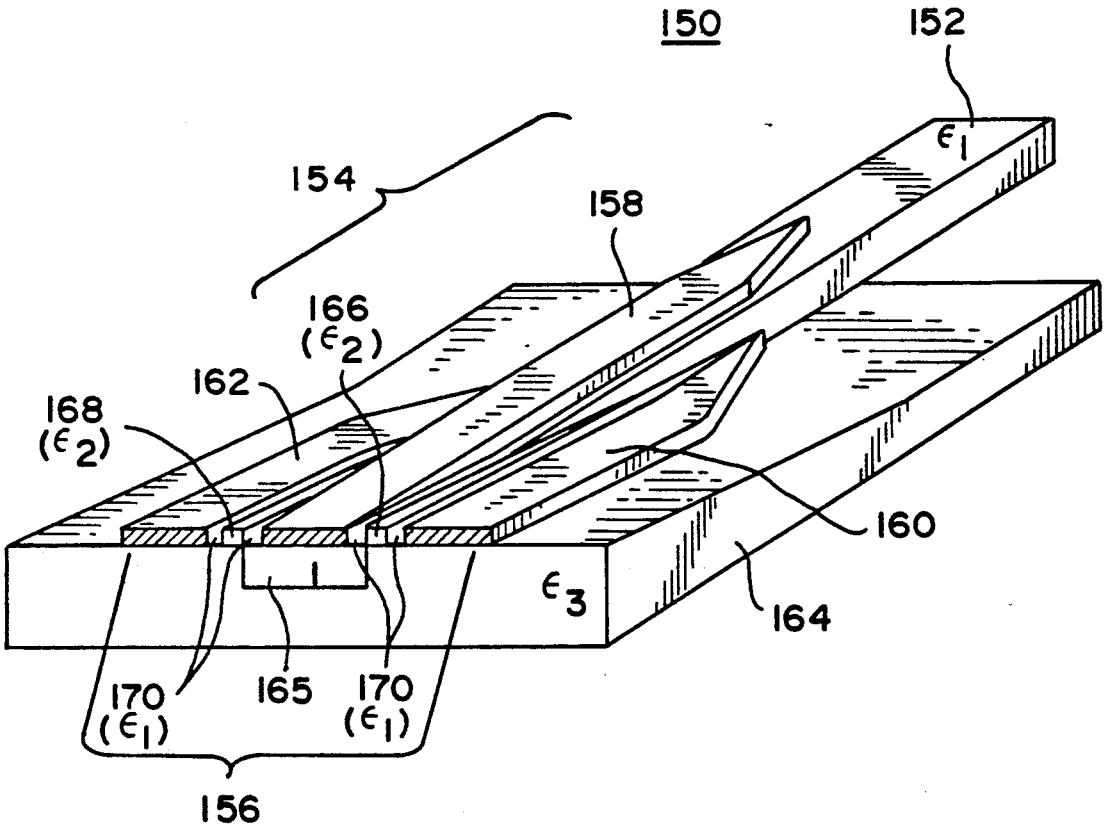
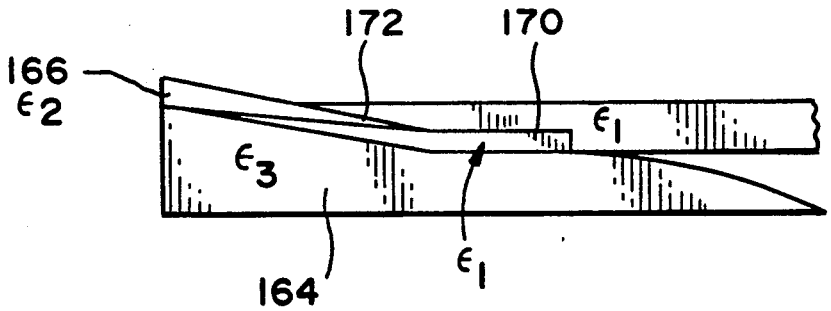
FIG. 3F

DIELECTRIC WAVEGUIDE-TO-COPLANAR TRANSMISSION LINE TRANSITIONS

BACKGROUND OF THE INVENTION

The present invention relates, in general, to transitions which are employed to interface dielectric waveguides to coplanar metallic microwave transmission lines.

In recent years, there has been increasing interest in designing integrated electronic circuits for operation in millimeter wave frequency ranges on the order of 100 GHz. At such frequencies, transmission lines used for component interconnection can attenuate the signal significantly due to the fact that the metallized regions of the transmission lines are imperfect conductors and cause resistive power dissipation. Dielectric waveguides can provide a much lower-loss guiding structure for signal propagation at these frequencies, and consequently are an attractive solution to the problem of signal power loss. In addition, dielectric waveguides can be manufactured to have greater mechanical flexibility and can therefore be used in a variety of applications in which geometrical constraints and signal attenuation prohibit the use of transmission lines. For example, signals can be routed throughout computers with less attenuation if dielectric waveguides are used in place of transmission lines. In addition, the mechanical flexibility in these guides makes them simpler to use than either transmission lines or conventional metallic waveguides for the interconnection of computers or of computer components.

These low-loss dielectric guiding structures, however, still require electrical connection to active high frequency structures, such as semiconductor devices. Thus, in order to use dielectric waveguides for component interconnection, it is necessary to combine both types of signal guiding technologies in high frequency integrated circuits. Since most high frequency integrated circuits employ coplanar metallic transmission lines for interconnection of devices, the problem must therefore be solved of interfacing signal propagation in coplanar metallic transmission lines to signal propagation in dielectric waveguides. If this can be accomplished successfully, the dielectric guide may be used for longer range signal interconnect requirements in the integrated structures, and the coplanar transmission line sections can be used for local signal propagation as needed for component requirements. In addition, the dielectric guiding structure lends itself to integration with optical components, thus coplanar metallic transmission line to dielectric waveguide transitions can also serve to combine microwave circuits and optical components in high frequency optical electronic integrated circuits.

SUMMARY OF THE INVENTION

In view of the foregoing, it is the object of the present invention to provide transition structures by which dielectric waveguides can be interfaced to conventional coplanar metallic transmission lines.

This and other objects of the invention are achieved in the various embodiments of the present invention with a number of different transition structures, all of which serve to interface signal propagation in a dielectric waveguide to signal propagation in coplanar metallic transmission lines. More particularly, the transition structures properly orient and match the electric field polarization of a signal in a cylindrical or rectangular dielectric waveguide with that of a signal in a coplanar transmission line.

In a first preferred embodiment of the invention, the transition structure is essentially composed of two sections, a first section forming a transition from a dielectric waveguide to a microstrip transmission line, and a second section forming a transition from the microstrip transmission line to a coplanar transmission line. In the first section, two conducting strips are gradually introduced on the top and bottom walls of a dielectric waveguide to polarize the transverse electric field in the waveguide vertically. A microstrip transmission line is then formed by widening the dielectric waveguide and the bottom conducting strip. At this point, the bottom conducting strip is disposed on a dielectric substrate. In the second section of the transition, the bottom conducting strip splits into two sections and the top conducting strip slopes down a tapered portion of the dielectric waveguide into a gap formed between the two bottom sections. These three conducting strips thereby form a coplanar transmission line on the dielectric substrate. It is seen from the symmetry of the structure that the coplanar waveguide is excited in the odd mode.

In a second embodiment of the present invention, a transition structure is provided in which a dielectric waveguide is interfaced directly to a coplanar transmission line. In this structure, a first conducting strip is gradually introduced above the top wall or side of a rectangular or cylindrical dielectric waveguide to polarize the transverse electric field of a signal propagating therein vertically. Once the transverse electric field of the signal is vertically polarized, two side conducting strips on a dielectric substrate are introduced on either side of, and slightly below, the lower interface of the waveguide. The transverse electric field lines will then emanate from the top conducting strip and terminate on the two side conducting strips. Next, the thickness of the dielectric waveguide is gradually reduced to zero so that the top conducting strip and two side conducting strips are now disposed on the same supporting substrate, thereby forming a coplanar transmission line.

In a modification of this embodiment of the invention, two tapered strips of relatively high dielectric constant are inserted between the center and the side conducting strips of the coplanar transmission line. The purpose of the strips is to affect the propagating modes in the transition so that the transverse field strength is reduced at the surface of the conducting strips. This reduction of field strength at the conducting surfaces is accompanied by a reduction of both surface charge and surface current carried by the conducting strips. The reduction of surface current results in a reduction of the resistive power dissipation in the transition structure which permits the use of lossy metals in the strips without significantly increasing signal attenuation in the transition.

In a third embodiment of the present invention, a transition structure is formed which is based on a "T" junction wherein a dielectric waveguide terminates at and forms the leg of a "T" junction, and the two cross arms of the "T" junction curve around and eventually become parallel to one another to form a coplanar transmission line. Various configurations of metallizations can be employed with this embodiment to provide the necessary transition between the dielectric waveguide and the coplanar transmission line which vertically polarize the transverse electric field of an incoming signal in the dielectric waveguide and convert it into a horizontally polarized electric field in each cross arm of the "T". The electric fields in each arm are in phase with one another and feed into the coplanar transmission line structure with the appropriate polarization of the electric field from the center conductor to each side conductor. This results in the coplanar transmission line operating in the less radiative anti-symmetric mode.

Alternatively, conducting strips can be placed on the side walls of the dielectric waveguide instead of on the top and bottom walls so that the horizontal polarization of the transverse electric field in the dielectric waveguide can be used for signal interfacing and matching. The "T" junction then converts this polarization into a symmetric-mode in the coplanar transmission line. This symmetric-mode can be used with the anti-symmetric mode in low noise detection schemes.

In yet another embodiment of the present invention, a transition structure is provided in which a dielectric waveguide is fed into a "Y" splitter along the direction of propagation so that the signal is split into two waveguides. Means are provided in one or both of the waveguides to change the polarization so that the transverse electric field in one waveguide is 180° out of phase with the transverse field in the other waveguide. At this point, conducting strips are introduced between the separated guides which feed into a coplanar transmission line.

The present invention also provides a power splitter structure comprising a dual transition from a coplanar transmission line to two dielectric waveguides. This transition divides the power carried by the coplanar transmission line equally into two dielectric waveguides, while the symmetry of the propagating mode in the coplanar transmission line provides a 180° phase relationship in their respective field polarization. The power splitting structure can be used to separate or combine signals from dielectric waveguides as needed in the various embodiments of the present invention.

If desired, a polarization rotation structure can be incorporated into any of the transitions. In this structure, two conducting strips are gradually introduced on the opposite sidewalls of a rectangular dielectric waveguide so that the transverse electric field is horizontally polarized. Then, the horizontal polarization is rotated into a vertical polarization by gradually rotating the placement of the conducting strips relative to the dielectric waveguide perimeter until they are disposed on the top and bottom walls of the waveguide. At this point, the transverse electric field is vertically polarized and the waveguide can be interfaced with any of the transitions of the present invention.

BRIEF DESCRIPTION OF THE DRAWINGS

The foregoing and additional objects, features and advantages of the present invention will become apparent from the following detailed description of preferred embodiments thereof, taken in conjunction with the accompanying drawings in which:

FIGS. 3C–F are schematic illustrations of modifications or variations of the transition structure illustrated in FIGS. 3A and 3B;

DETAILED DESCRIPTION OF THE PREFERRED EMBODIMENTS

Figure 1A:
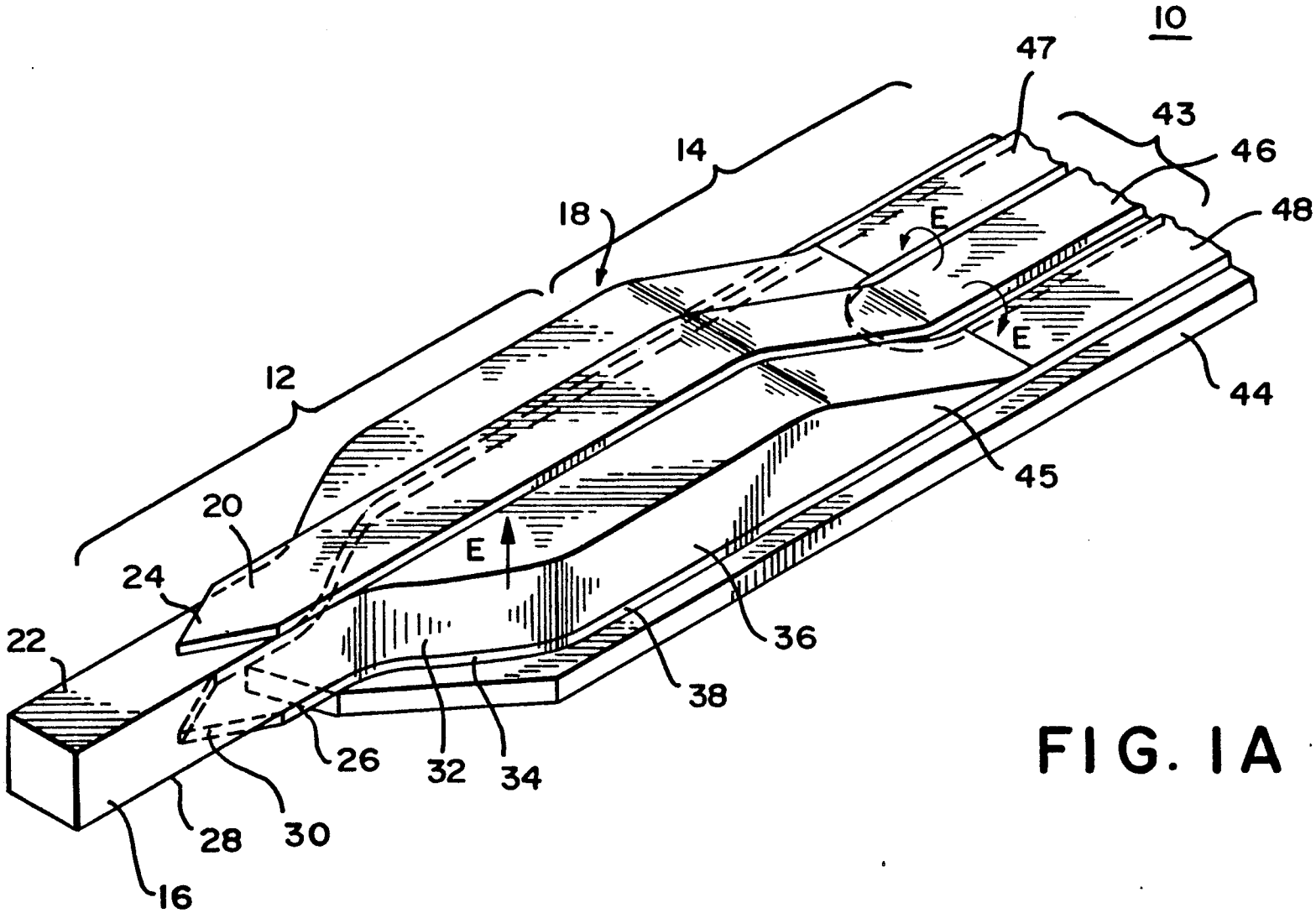
FIG. 1A is a schematic illustration of a transition structure which forms a first preferred embodiment of the present invention.

Turning now to a more detailed consideration of several preferred embodiments of the present invention, there is illustrated in FIG. 1A, a dielectric waveguide-to-coplanar transmission line transition 10 which includes a first section 12 and a second section 14. The first section 12 comprises a transition between a rectangular dielectric waveguide 16 and a microstrip transmission line 18.

In the first section 12, a first conducting strip 20 is gradually introduced on a top wall 22 of the waveguide 16 by means of a tapered end 24, and a second conducting strip 26 is similarly gradually introduced on a bottom wall 28 of the waveguide 16 by means of a tapered end 30. The tapered ends 24 and 30 serve to provide a gradual transition between the dielectric waveguide 16 and the microstrip transmission line 18 to minimize unwanted reflections between the two. The dielectric waveguide 16 and second conducting strip 26 fan out as illustrated at 32 and 34, respectively, to form widened portions 36 and 38, respective, thereof. The widened portions 36 and 38, in conjunction with the first conducting strip 20, form the microstrip transmission line 18.

Figures 1B, 2:
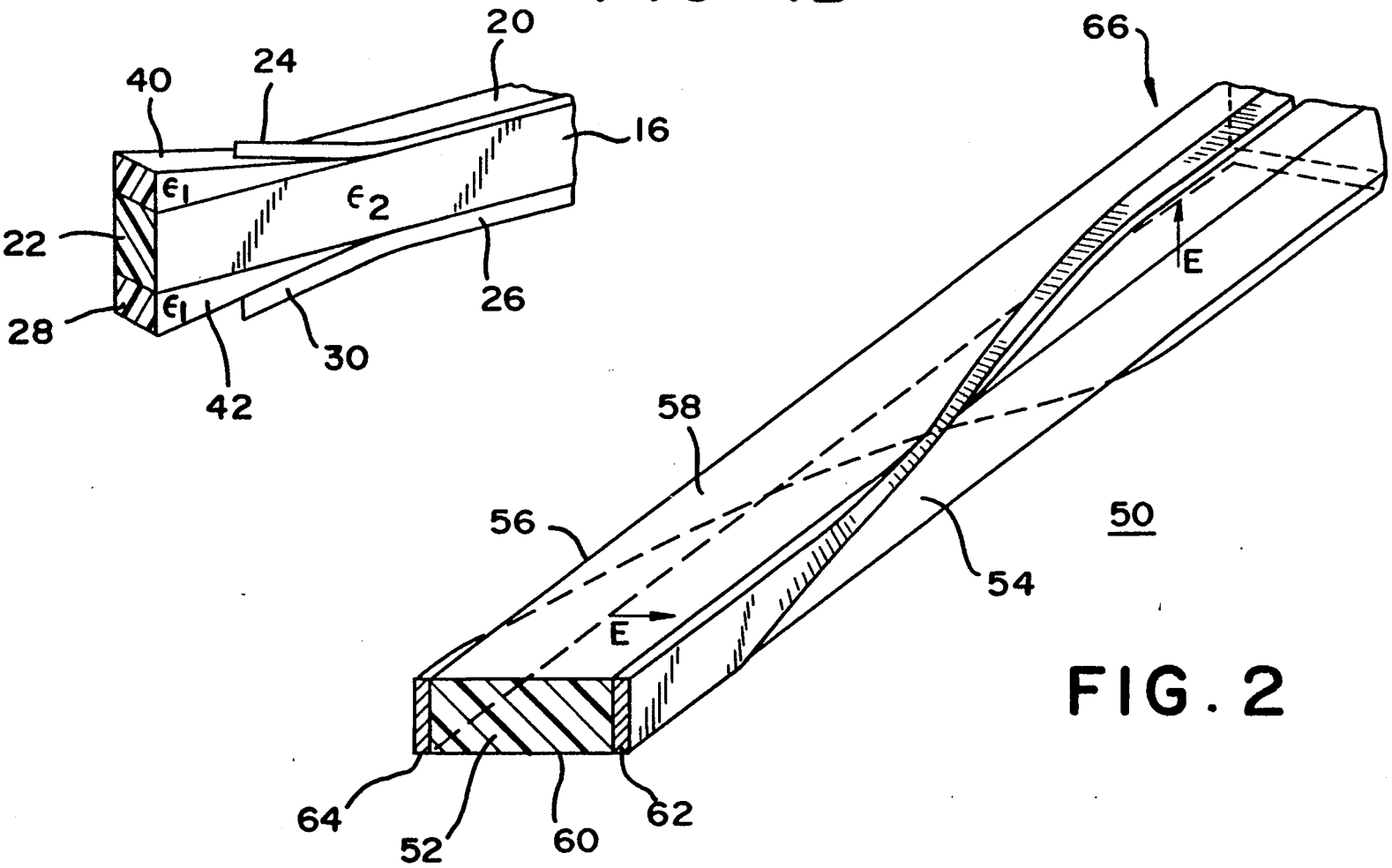
FIG. 1B is a schematic illustration of a modified portion of the transition structure of FIG. 1A.
FIG. 2 is a schematic illustration of a polarization rotation structure which can be employed with the preferred embodiments of the present invention.

An alternative technique for gradually introducing the first and second conducting strips 20 and 26 is illustrated in FIG. 1B. In particular, the dielectric waveguide 16 is illustrated as having first and second tapered dielectric strips 40 and 42 disposed on its top and bottom walls 22 and 28, respectively. The first and second conducting strips 20 and 26 are then disposed on the tapered dielectric strips 40 and 42, respectively, such that they gradually approach, and then contact, the top and bottom walls 22 and 28, respectively, of the dielectric waveguide 16. As also illustrated in FIG. 1B, the tapered ends 24 and 30 of the first and second conducting strips 20 and 26, respectively, can be included as well with this technique. It should be noted that the dielectric constant $\epsilon_1$ of the tapered dielectric strips 40 and 42 should be lower than the dielectric constant $\epsilon_2$ of the dielectric waveguide 16.

Returning now to FIG. 1A, the second section 14 of the transition 10 comprises a transition between the microstrip transmission line 18 and a coplanar transmission line 43 disposed on a dielectric substrate 44. The second section 14 includes a tapered portion 45 of the widened portion of the dielectric waveguide 16 which gradually reduces in height so that the conducting strip 20 becomes a central conducting strip 46 of the coplanar transmission line 43. The widened portion of the lower conducting strip 26 divides into first and second legs 47 and 48 to form the ground plane conducting strips of the coplanar transmission line 43.

In the operation of the transition structure 10 illustrated in FIG. 1A, a signal propagating through the dielectric waveguide 16 is vertically polarized by the positioning of the conductors 20 and 26 as illustrated by the E and the arrow. Then, as the signal travels through the second section 14, the polarization of the transverse electric field is gradually rotated to horizontal between the center conducting strip 46 of the coplanar transmission line 43 and the ground plane conducting strips 47 and 48.

If desired, a mode which has a horizontally polarized transverse electric field can be employed in the transition structure 10 of FIG. 1A by employing the structure of FIG. 2. In particular, FIG. 2 illustrates a polarization rotation structure 50 which includes a rectangular dielectric waveguide 52 having first and second sidewalls 54 and 56, a top wall 58 and a bottom wall 60. First and second conducting strips 62 and 64 are disposed on the sidewalls 54 and 56, respectively, for horizontally polarizing the transverse electric field as indicated by the E and the arrow. These strips gradually rotate about the length of the waveguide 52 so that the first strip 62 eventually is disposed on the top wall 58 of the waveguide 52, and the second strip 64 is eventually disposed on the bottom wall 60 of the waveguide 52. This causes the transverse electric field of a signal propagating through the waveguide 52 to be rotated into a vertical polarization, thereby forming a microstrip configured transmission line 66 at the point where the strips 62 and 64 are disposed on the top and bottom walls 58 and 60, respectively. The microstrip transmission line 66 can then be interfaced to a transition structure, such as the structure illustrated in FIG. 1, for interfacing the microstrip transmission line 66 to a coplanar transmission line. The rotation structure of FIG. 2 therefore enables a transition to operate with the mode which has a horizontally polarized transverse electric field in addition to the mode which has a vertically polarized transverse electric field.

Figure 3A:
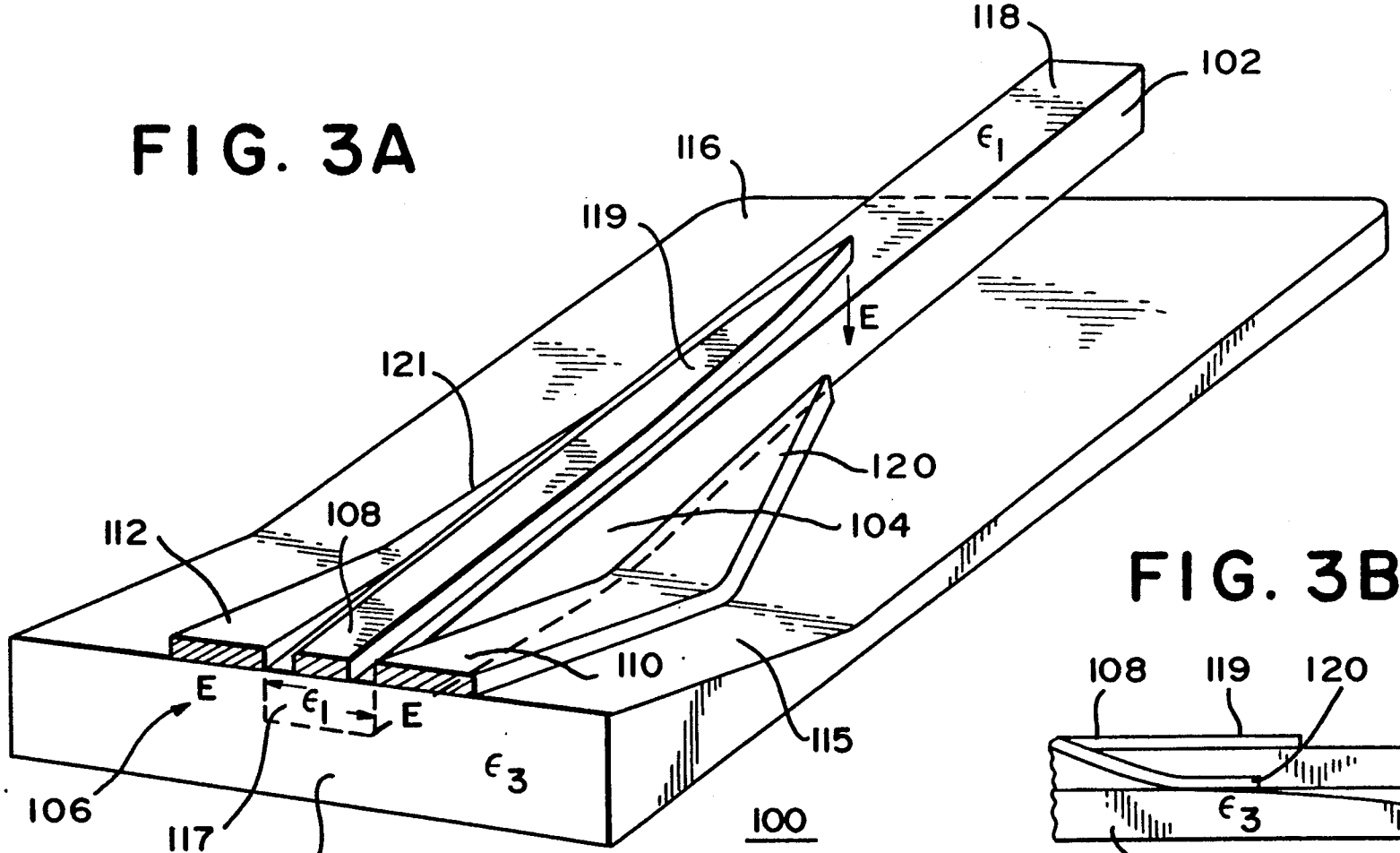
FIGS. 3A and 3B are schematic illustrations of a transition structure which forms a second preferred embodiment of the present invention.
Figure 3B:
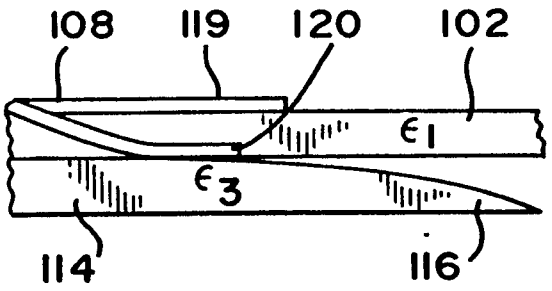

Turning now to FIGS. 3A and 3B, a transition structure 100 is illustrated which forms a second preferred embodiment of the present invention. In particular, the transition 100 includes a rectangular dielectric waveguide 102 having a tapered end portion 104 for interfacing with an integral coplanar transmission line 106. The coplanar transmission line 106 is comprised of a center conducting strip 108 and first and second ground plane conducting strips 110 and 112, all of which are disposed on a dielectric substrate 114 having a dielectric constant $\epsilon_3$. As illustrated, the dielectric substrate 114 includes a sloped portion 115 which merges with the tapered end portion 104 of the dielectric waveguide 102 to provide a smooth transition between the waveguide and the coplanar transmission line 106. Also, as best illustrated in the side view of FIG. 3B, the dielectric substrate 114 includes a tapered opposite end 116 which gradually curves away from the waveguide 102 to avoid reflections due to abrupt changes in the waveguide/substrate interface. Alternatively, cladding of the waveguide 102 can be utilized to make the transition even more gradual.

The dielectric waveguide 102 has a dielectric constant $\epsilon_1$ which can have a value greater than the dielectric constant $\epsilon_3$ of the substrate 114, if desired. Increasing this parameter ($\epsilon_1$) serves to concentrate the power of the propagating mode in the waveguide region and thereby increase the efficiency of the transition. A rectangular section 117 of the substrate 114 which joins to the waveguide 102 is also chosen to have the same dielectric constant, $\epsilon_1$, of the waveguide when $\epsilon_1$ is chosen greater than $\epsilon_3$. It may be advantageous to attach an additional section to this plane in which the dielectric constant of the $\epsilon_1$ region gradually tapers to zero cross section (or the dielectric constant goes to $\epsilon_3$) in the direction of propagation leaving only the substrate, $\epsilon_3$, and the coplanar transmission line.

The center strip 108 extends along the tapered portion 104 of the dielectric waveguide 102 on a top wall 118 thereof and includes a tapered end portion 119. Similarly, the ground plane strips 110 and 112, which remain on the plane of the dielectric substrate 114, have tapered end portions 120 and 121, respectively. The tapered end portions of the various conducting strips serve to reduce unwanted reflections between the dielectric waveguide 102 and the coplanar transmission line 106.

The principle of operation of the transition 100 illustrated in FIGS. 3A and 3B, is that a signal which propagates from the dielectric waveguide 102 to the coplanar transmission line 106 will first be polarized vertically by the gradual introduction of the center conducting strip 108 on the top wall 118 of the waveguide 102. When the transverse electric field is vertically polarized, the two ground plane strips 110 and 112 are introduced on either side of and slightly below the waveguide 102. The transverse electric field lines will then emanate from the center strip 108 and terminate on the two ground plane strips 110 and 112 and as the ground plane strips ascend the sloped portion 115, the field lines will gradually be rotated to horizontal as illustrated.

Figure 3C:
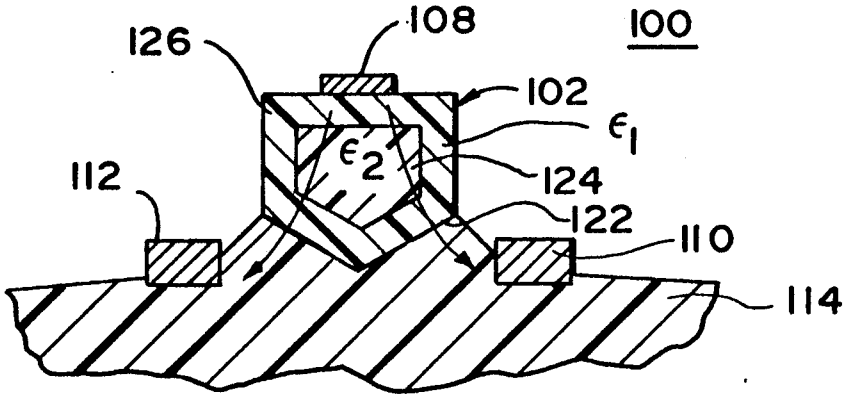

A first modification to the structure illustrated in FIG. 3A is illustrated in FIG. 3C. In particular, FIG. 3C is a cross sectional view of the transition structure 100 in which a V-shaped lower interface 122 is formed between the dielectric waveguide 102 and the dielectric substrate 114. The use of the V-shaped interface 122 can improve the efficiency of the transition structure 100 by aiding in directing the transverse electric field lines indicated by the arrows from the center conducting strip 108 to the two side conducting strips 110 and 112.

To more advantageously utilize the V-shaped lower interface 122, the dielectric waveguide 102 can be cladded as illustrated and include a core region 124 of dielectric constant $\epsilon_2$, and a cladding layer 126 of dielectric constant $\epsilon_1$, with $\epsilon_2$ greater than $\epsilon_1$. The core region 124 can be tapered along the direction of propagation so that near the transmission line end of the structure 100, the core region 124 completely disappears. From all other aspects, the principle of operation of the modified structure remains identical to that of the structure of FIG. 3A.

Figure 3D:
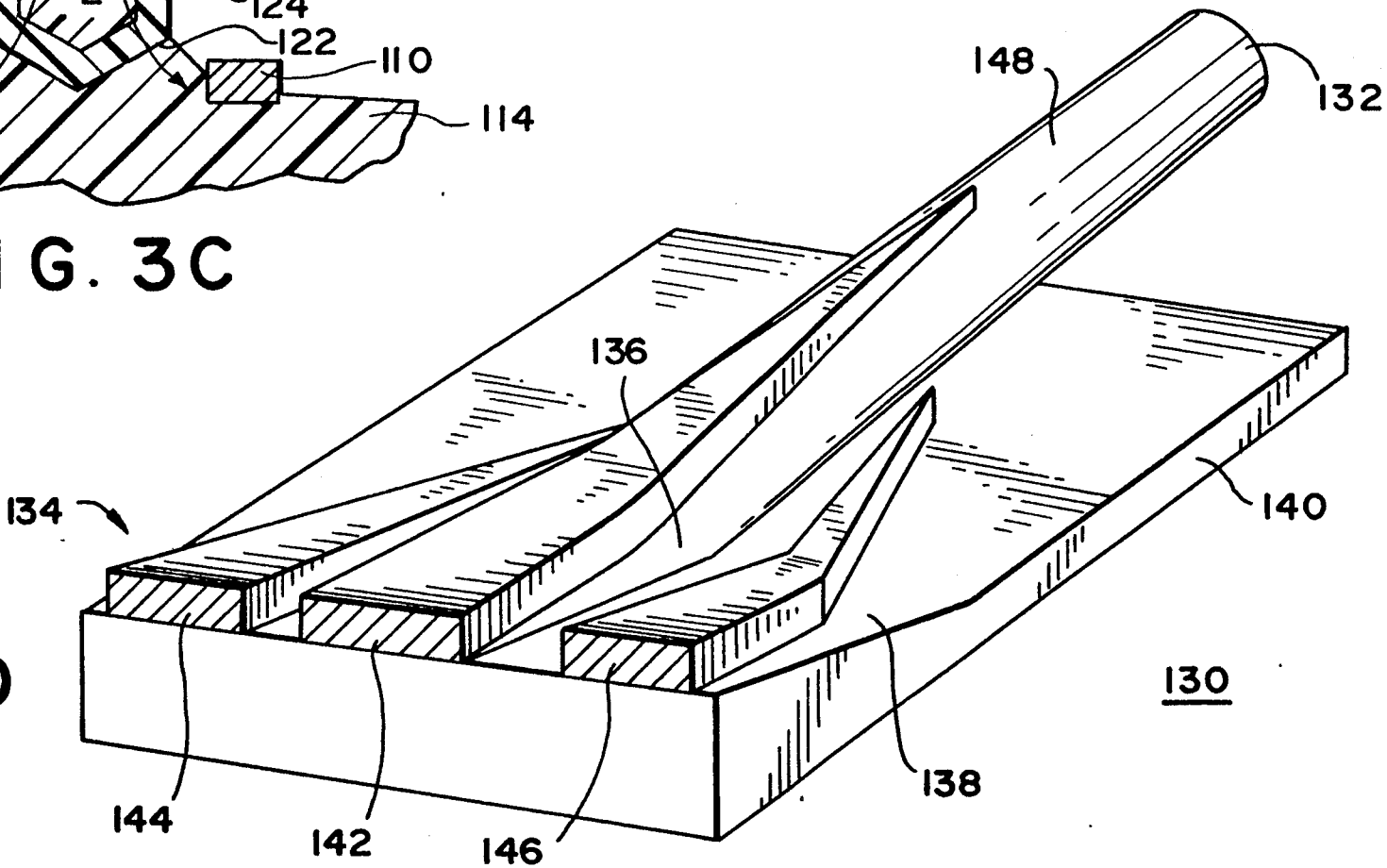

Yet another variation of the dielectric guide-to-transmission line transition of FIG. 3A is illustrated in FIG. 3D. In particular, a transition structure 130 is illustrated for interfacing a cylindrical dielectric waveguide 132 to a coplanar transmission line 134. The transition structure 130 is otherwise very similar to the transition structure 100 of FIG. 3A, and includes a tapered portion 136 of the cylindrical dielectric waveguide 132 which merges with a sloped portion 138 of a dielectric substrate 140 to form a smooth transition between the cylindrical waveguide 132 and the coplanar transmission line 134. The coplanar transmission line 134 is comprised of a center conducting strip 142 and first and second ground plane conducting strips 144 and 146, all of which are disposed on the dielectric substrate 140. The center conducting strip 142 extends along the top side 148 of the cylindrical dielectric waveguide 132, while the ground plane conducting strips 144 and 146 remain on the plane of the dielectric substrate 140.

The transition structure 130 of FIG. 3D operates on the same principle as that of the transition structure 100 of FIG. 3A, except that the $HE_{11}$ mode of the cylindrical dielectric guide 132 is used instead of the vertically polarized propagating mode of the rectangular dielectric guide 102 in FIG. 3A. It should be noted that a substitution of a cylindrical dielectric waveguide for a rectangular dielectric waveguide can be made in the transition illustrated in FIG. 1A, as well as in any of the other transition structures disclosed herein.

Turning now to FIGS. 3E and 3F, there is illustrated yet another modification to the structure illustrated in FIG. 3A. In particular, a transition structure 150 is illustrated which, like the transition structure 100 of FIG. 3A, includes a dielectric waveguide 152, a dielectric waveguide-to-coplanar transmission line transition section 154 and a coplanar transmission line 156. The coplanar transmission line 156 includes a central conducting strip 158 and first and second ground plane conducting strips 160 and 162. Each of these strips are disposed on a dielectric substrate 164 having a dielectric constant $\epsilon_3$, which can be less than $\epsilon_1$ as in the transition 100 of FIG. 3A, with the exception of a rectangular portion 165 corresponding to the waveguide 152 which has the same dielectric constant, $\epsilon_1$. If desired this $\epsilon_1$ portion can be tapered to zero along the coplanar line as in the discussion of the embodiments of FIG. 3A. The difference between the transition structure 150 of FIGS. 3D and 3E and the transition structure 100 of FIG. 3A is that first and second tapered strips 166 and 168 of material having a relatively high dielectric constant $\epsilon_2$, are disposed between the center conducting strip 158 and the ground plane conducting strips 160 and 162, respectively. The strips of high dielectric constant material 166 and 168 are separated from the conducting strips 158, 160 and 162 by a plurality of strips of material 170 having a different dielectric constant which can be less than $\epsilon_2$ and in particular may have the same dielectric constant, $\epsilon_1$, as that of the waveguide 152. As illustrated in the side view of FIG. 3F, each of the strips 166 and 168 has a tapered end portion 172 which is positioned in the transition section 154.

The use of the high dielectric constant material strips 166 and 168 affects the propagating modes in the transition structure 150 because in a proper design the region of highest power density of the propagating modes is concentrated in the high dielectric material, and will be attenuated in the lower dielectric material. As a result, the insertion of the high dielectric constant strips 166 and 168 reduces the transverse electric field strength at the surface of the conducting strips 158, 160 and 162 as compared to the strength of these same fields in the simpler dielectric transition structure 100 of FIG. 3A. This reduction of field strength at the conductor surfaces is accompanied by a reduction of both surface charge and surface current carried by the conductors. A reduction of surface current results in a reduction of the resistive power dissipation in the transition structure 150. This permits the use of lossy metallization in the coplanar transmission line 156 of the transition structure 150 without significantly increasing signal attenuation in the transition structure 150.

Figure 4A:
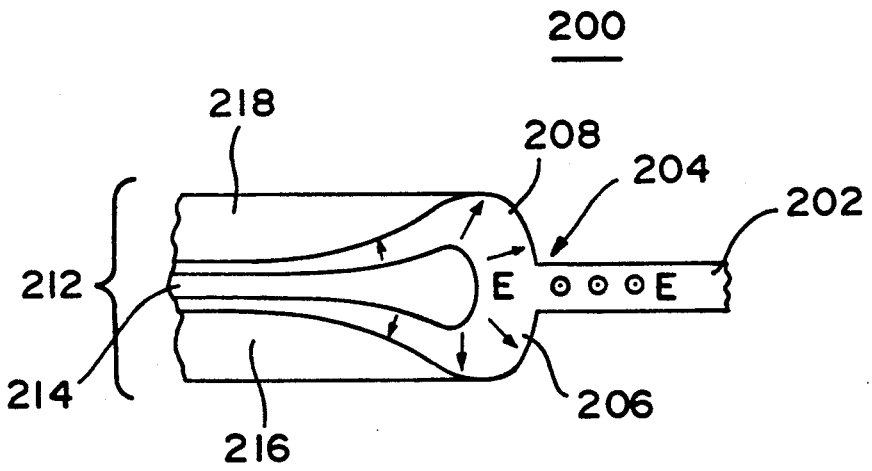
FIG. 4A is a top view schematic illustration of a transition structure which forms a third preferred embodiment of the present invention.

Turning now to FIG. 4A, there is illustrated a third preferred embodiment of the present invention. In particular, a "T" junction transition structure 200 is illustrated in which a dielectric waveguide 202 forms the leg of a "T" junction 204. First and second cross arms 206 and 208 of the "T" junction 204 extend perpendicularly to the waveguide 202 in opposite directions. Each of the cross arms 206 and 208 then curves at substantially right angles to become parallel to one another and feed into a coplanar transmission line 212 formed of a center conducting strip 214 and two ground plane conducting strips 216 and 218.

Figure 4B:
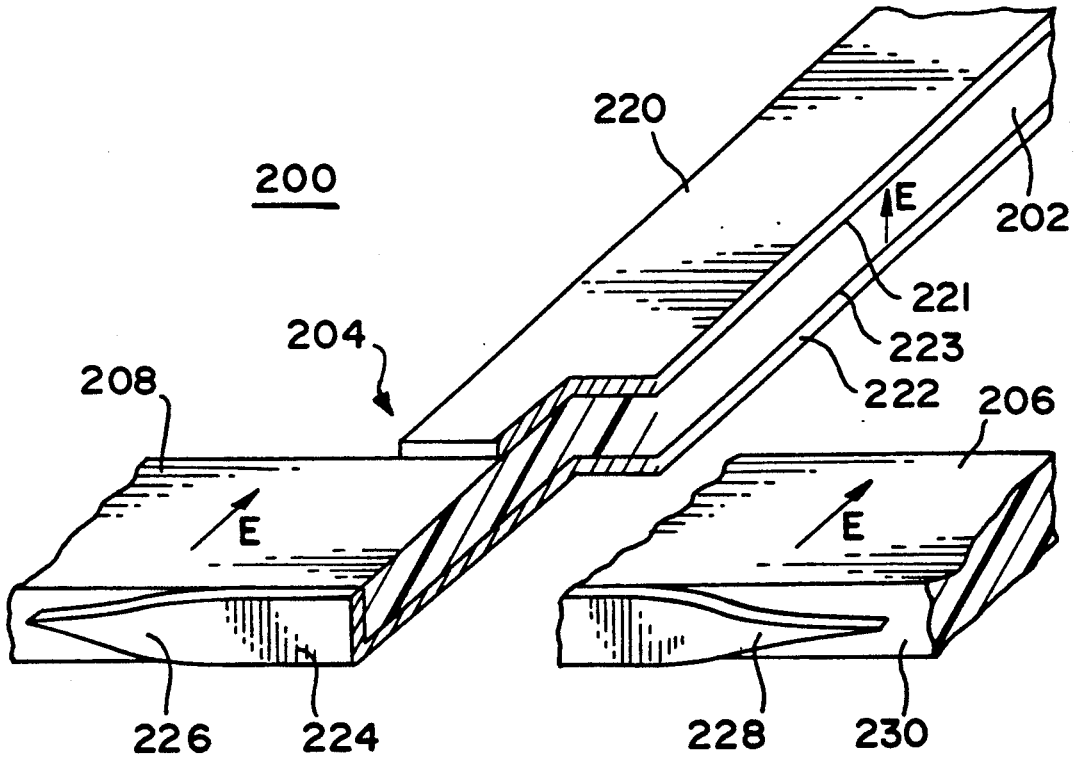
FIGS. 4B–D are schematic illustrations of three variations of "T" junctions which can be employed with the transition structure of FIG. 4A.
Figure 4C:
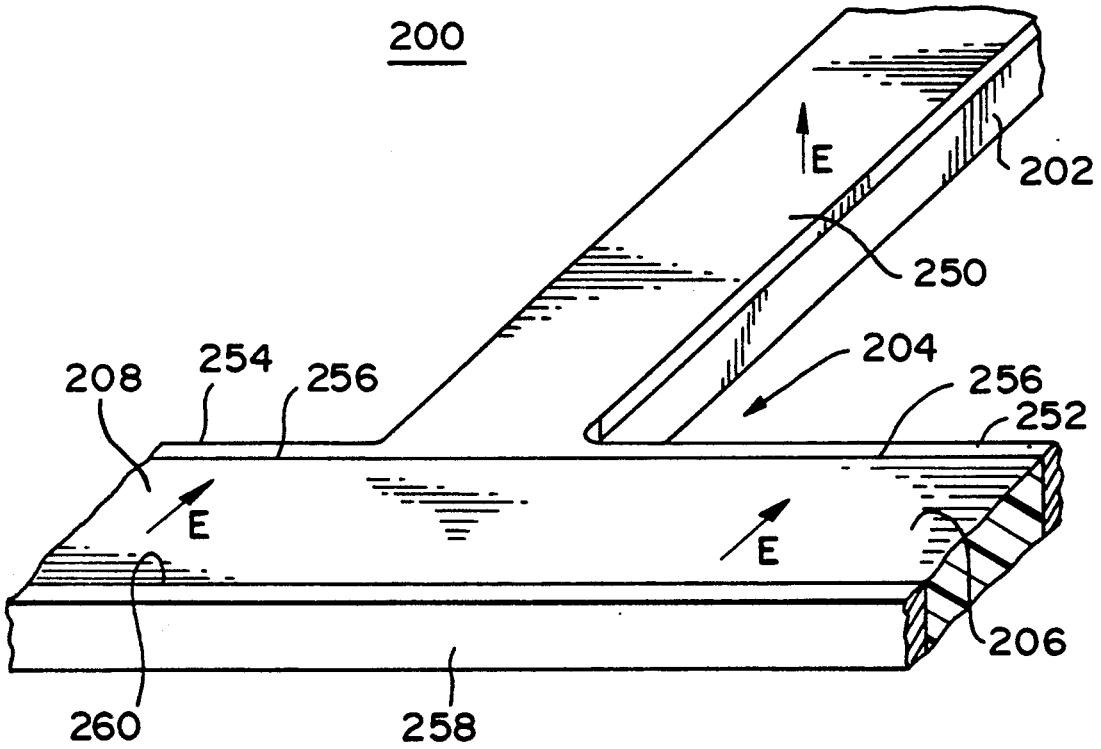
Figure 4D:
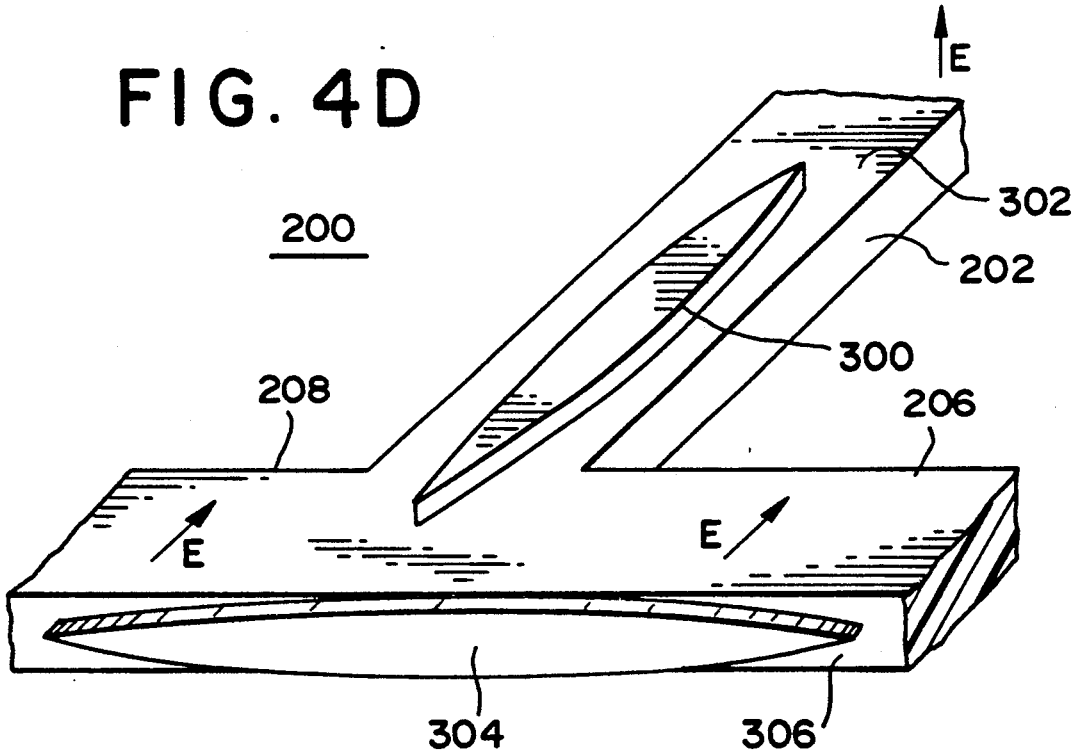

Three different metallization configurations for the "T" junction 204 of FIG. 4A are illustrated in FIGS. 4B–D. In particular, in FIG. 4B, a conducting strip 220 is formed on a top wall 221 of the dielectric waveguide 202 which terminates where the waveguide 202 intersects the cross legs 206 and 208. A conducting strip 222 is disposed on a bottom wall 223 of the dielectric waveguide 202 which extends beneath the cross legs 206 and 208 and includes a vertical extension 224 having first and second tapered ends 226 and 228 disposed on a front wall 230 of the cross legs 206 and 208. The strips 220 and 222 serve to polarize vertically the transverse electric field in a signal propagating through the dielectric waveguide 202 to the "T" junction 204 and then rotate the transverse electric field to a horizontal polarization in each of the cross legs 206 and 208. The electric fields in each of the cross arms 206 and 208 are in phase with each other and when the arms 206 and 208 are bent around to feed into the coplanar transmission line 212, the electric field will have the appropriate polarization from the center conducting strip 214 to each ground plane conducting strip 216 and 218.

In the variation illustrated in FIG. 4C, a top conducting strip 250 disposed on the dielectric waveguide 202 also terminates at the "T" junction 204, but then joins first and second conducting strips 252 and 254 on a back side 256 of the cross arms 206 and 208. A second conducting strip 258 is disposed on a front side 260 of the cross arms 206 and 208. The resulting operation is the same as that of the variation illustrated in FIG. 4B.

Another variation is illustrated in FIG. 4D, which again provides the same mode of operation as the variations illustrated in FIGS. 4B and 4C, but is designed to minimize the area covered by metallized regions and thus achieve the desired transverse electric field polarizations with minimal attenuation. In particular, a small tapered conducting strip 300 is disposed on a top wall 302 of the waveguide 202 to polarize vertically the transverse electric field of an incoming signal in the dielectric waveguide 202, while a similar tapered conducting strip 304 is disposed on a front wall 306 of the cross arms 206 and 208 of the "T" junction 204 to rotate the transverse electric field to a horizontally polarized position as shown.

Figure 5A:
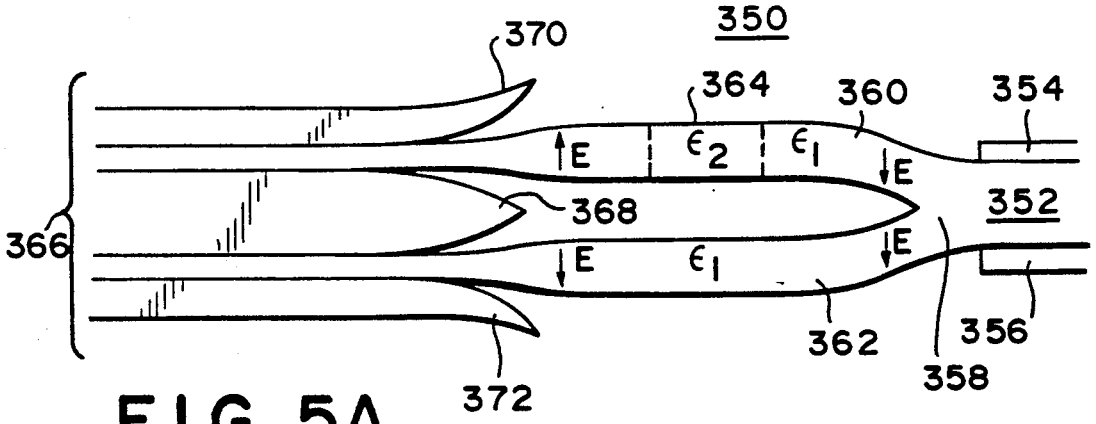
FIGS. 5A and 5B are schematic illustrations of two variations of a transition structure which forms a fourth preferred embodiment of the invention; and, FIG. 6 is a schematic illustration of a power splitting structure which can be employed with the preferred embodiments of the present invention.
Figure 5B:
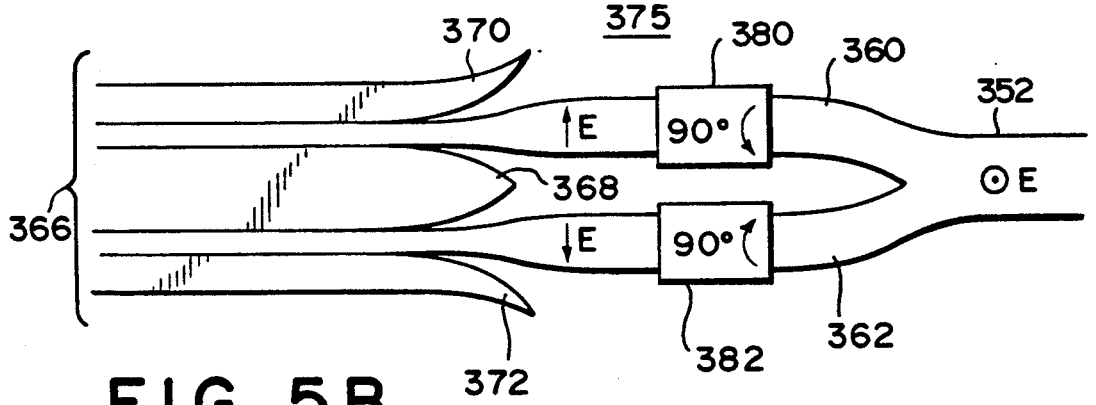

Turning now to FIGS. 5A and 5B, two variations of a fourth preferred embodiment of the present invention are illustrated. In particular, a Y-transition structure 350 is illustrated in FIG. 5A in which a dielectric waveguide 352 is made to allow propagation of only horizontal transverse electric fields by positioning first and second conducting strips 354 and 356 along opposite sides of the dielectric waveguide 352. The dielectric waveguide 352 splits at a "Y" splitter 358 into two separate dielectric wave guides 360 and 362. The waveguides 360 and 362 have the same dielectric constant, $\epsilon_1$, with the exception of a modified dielectric region 364 of the waveguide 360, which has a dielectric constant $\epsilon_2$ chosen so that the speed of propagation of a signal through the region 364 is either increased or decreased so that the relative time phase of a signal in the waveguide 360 will be rotated 180° out of phase with respect to a signal in the second waveguide 362. As illustrated by the arrows in FIG. 5A, this causes the electric fields to be opposite to one another so that the waveguides 360 and 362 can then be easily interfaced to a coplanar transmission line 366 including a center conducting strip 368 and two ground plane conducting strips 370 and 372. Thus, the first waveguide 360 interfaces a signal between the center conducting strip 368 and the first ground plane strip 370 of the coplanar transmission lines 366, while the second waveguide 362 interfaces a signal between the center conducting strips 36 and the second ground plane strips 372 of the coplanar transmission line 366.

A variation of the Y-transition structure 350 of FIG. 5A is illustrated in FIG. 5B. In particular, a Y-transition structure 375 is shown in FIG. 5B which includes most of the same elements of the transition structure 350 of FIG. 5A with the exception that first and second polarization rotation sections 380 and 382 are disposed, one each, in the waveguides 360 and 362, respectively. The polarization rotation section 380 rotates a signal in the waveguide 360 90° counterclockwise, while the polarization rotation section 382 rotates a signal in the waveguide 362 90° clockwise to obtain the required 180° time phase relationship between the two waveguides as they are interfaced to the coplanar transmission line 366. With this arrangement, the electric field of a signal in the waveguide 352 is vertically polarized as shown.

The polarization rotation in the sections 380 and 382 can be effected in several ways. One way is by a rotation structure such as the structure 50 illustrated in FIG. 2. Another way is by a physical twisting of the waveguide by 90°, provided the fundamental propagation mode is non-degenerate. A third way is by introducing two birefringent sections that are the microwave analog of optical half-wave plates. Finally, a fourth way would be to use the Faraday effect.

Figure 6:
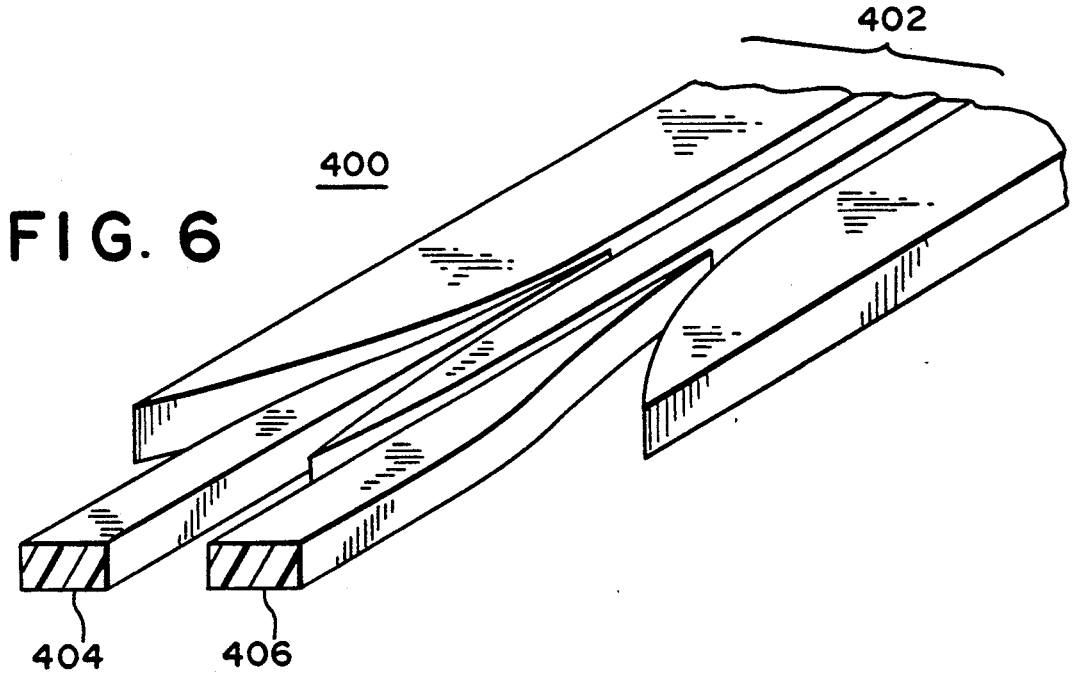

Finally, FIG. 6 illustrates a power splitter structure 400 which can be described as a dual transition from a coplanar transmission line 402 to first and second dielectric waveguides 404 and 406. This structure is similar to a portion of the transition structure 350 illustrated in FIGS. 5A and 5B. The power splitter 400 divides the power carried by the coplanar transmission line 402 equally into the two dielectric waveguides 404 and 406, while the symmetry of the propagating mode in the coplanar transmission line 402 provides a 180° phase relationship in their respective field polarizations. The power splitting structure 400 can be employed with any of the transitions illustrated in FIGS. 1, 3 or 4 to separate or combine signals from the dielectric waveguides as needed. For example, the coplanar transmission line 402 can be attached directly to the coplanar transmission line 212 of the "T" junction transition structure 200 shown in FIG. 4A to combine the signals of two dielectric waveguides into a single dielectric waveguide. These power splitting structures can also make use of the multi-dielectric layers as described above to reduce resistive losses.

Although the invention has been described in terms of a number of preferred embodiments, it will be understood that numerous modifications and variations could be made thereto without departing from the true spirit and scope of the invention as set forth in the following claims.

What is claimed is:

1. A structure for interfacing a dielectric waveguide to a coplanar transmission line comprising:

a) a dielectric waveguide;

b) a coplanar transmission line; and, c) transition means disposed between said dielectric waveguide and said coplanar transmission line for matching the electric field polarization of a signal in said dielectric waveguide with the electric field polarization of a signal in said coplanar transmission line, said transition means comprising:

i) a first transition section between said dielectric waveguide and a microstrip transmission line; and, ii) a second transition section between said microstrip transmission line and said coplanar transmission line.

2. The structure of claim 1 wherein said first transition section further comprises:

a first conducting strip gradually introduced on a top wall of said dielectric waveguide for vertically polarizing a signal propagating through said waveguide; and, a second conducting strip gradually introduced on a bottom wall of said dielectric waveguide; and, said second transition section comprises:

a tapered end portion of said dielectric waveguide wherein said top wall slopes down to interface said coplanar transmission line, said first conducting strip on said top wall becomes a central conductor of said coplanar transmission line and said second conducting strip splits into first and second ground plane conductors of said coplanar transmission line.

3. A structure for interfacing a dielectric waveguide to a coplanar transmission line comprising:

a) a dielectric waveguide;

b) a coplanar transmission line; and, c) transition means disposed between said dielectric waveguide and said coplanar transmission line for matching the electric field polarization of a signal in said dielectric waveguide with the electric field polarization of a signal in said coplanar transmission line, said transition means comprising:

i) a first-conducting strip gradually introduced on a top side of said dielectric waveguide for vertically polarizing a signal propagating through said waveguide;

ii) second and third conducting strips disposed on a dielectric substrate adjacent a bottom side of said dielectric waveguide on either side thereof; and, iii) a tapered portion of said dielectric waveguide disposed on said dielectric substrate between said second and third conducting strips, wherein said first conducting strip is gradually introduced onto said substrate between said second and third conducting strips, thereby forming said coplanar transmission line.

4. The structure of claim 3, wherein said dielectric waveguide is rectangular in cross section.

5. The structure of claim 3, wherein said dielectric waveguide is cylindrical in cross section.

6. A structure for interfacing a dielectric waveguide to a coplanar transmission line comprising:

a) a dielectric waveguide;

b) a coplanar transmission line; and, c) transition means disposed between said dielectric waveguide and said coplanar transmission line for matching the electric field polarization of a signal in said dielectric waveguide with the electric field polarization of a signal in said coplanar transmission line, said transition means comprising:

i) a "T" junction wherein said dielectric waveguide forms a leg of said "T" junction, said "T" junction also including first and second cross arms;

ii) means to split a vertically polarized signal in said dielectric waveguide into a first horizontally polarized signal in said first cross arm, and a second horizontally polarized signal in said second cross arm; and, iii) means to couple the signals in said first and second cross arms into said coplanar transmission line.

7. A structure for interfacing a dielectric waveguide to a coplanar transmission line comprising:

a) a dielectric waveguide;

b) a coplanar transmission line; and, c) transition means disposed between said dielectric waveguide and said coplanar transmission line for matching the electric field polarization of a signal in said dielectric waveguide with the electric field polarization of a signal in said coplanar transmission line; and, d) a polarization rotation structure interfaced between said dielectric waveguide and said transition means for horizontally polarizing the electric field of a signal in said waveguide, and then rotating the polarization of said signal to vertical before said signal enters said transition means.

8. A structure for interfacing first and second dielectric waveguides to a coplanar transmission line comprising:

first and second parallel dielectric waveguides;

a coplanar transmission line including a center conducting strip and first and second, ground plane conducting strips; and, transition means for interfacing said first dielectric waveguide between said center conducting strip and said first ground plane strip; and said second dielectric waveguide between said center conducting strip and said second ground plane strip.

9. The structure of claim 8, further including:

a splitter for interfacing said first and second dielectric waveguides with a third dielectric waveguide; and, a modified dielectric region of said first dielectric waveguide for rotating the electric field of a signal propagating therein 180° out of phase to that of a signal propagating in said second dielectric waveguide;

whereby, said structure forms a transition between said third dielectric waveguide and said coplanar transmission line.

10. The structure of claim 8, further including:

a splitter for interfacing said first and second dielectric waveguides with a third dielectric waveguide;

a first polarization rotation section disposed in said first dielectric waveguide for rotating the electric field of a signal propagating therein 90° counterclockwise out of phase to that of a signal propagating in said second dielectric waveguide; and, a second polarization rotation section disposed in said second dielectric waveguide for rotating the electric field of a signal propagating therein 90° clockwise out of phase to that of a signal propagating in said first dielectric waveguide;

whereby, said structure forms a transition between said third dielectric waveguide and said coplanar transmission line.

* * * * *